United States Patent [19]

Nutter

[11] 4,437,809

[45] Mar. 20, 1984

[54] TURNING GEAR INTERLOCK

[75] Inventor: Norman E. Nutter, Lunenburg, Mass.

[73] Assignee: General Electric Company, Lynn, Mass.

[21] Appl. No.: 336,500

[22] Filed: Dec. 31, 1981

[51] Int. Cl.³ ..... F01D 15/12; F01D 21/00

[52] U.S. Cl. ..... 415/41; 60/646; 251/94; 415/122 R

[58] Field of Search ..... 415/36–42, 415/122 R; 60/39.142, 646; 137/499, 595, 594, 597; 251/94, 320–323; 74/380, 384

[56] References Cited

U.S. PATENT DOCUMENTS

| | | | |
|---|---|---|---|
| 2,466,358 | 4/1949 | Besserdich et al. | 415/41 |
| 2,962,859 | 12/1960 | Hodgson et al. | 60/39.142 |
| 3,441,040 | 4/1969 | Gray | 415/41 |
| 3,919,894 | 11/1975 | Keeter et al. | 74/384 |
| 4,083,382 | 4/1978 | Khatti et al. | 251/94 |
| 4,193,739 | 3/1980 | Lucey | 60/39.142 |
| 4,267,738 | 5/1981 | Hausermann | 74/8 |
| 4,267,740 | 5/1981 | Schwarz | 74/128 |

FOREIGN PATENT DOCUMENTS

| | | | |
|---|---|---|---|
| 1054856 | 4/1959 | Fed. Rep. of Germany | 251/94 |
| 671206 | 11/1956 | United Kingdom | 60/646 |

*Primary Examiner*—Stephen Marcus

*Attorney, Agent, or Firm*—James W. Mitchell

[57] ABSTRACT

Rotor turning gears for turbines selectively engage with and disengage from rotor ring gears to provide for rotation of the turbine rotor when it would otherwise cease rotation. This is to equalize the effect of thermal stresses on the rotor as it cools down from operating temperatures. The turning gear is positioned by a movable carriage and interlock. The interlock prevents inadvertent engagement of the turning gear and rotor; inadvertent steam admission to the turbine when the turning gear is engaged and assures gear mesh oil to the turning gear during turning gear engagement.

7 Claims, 5 Drawing Figures

TURNING GEAR INTERLOCK

BACKGROUND OF THE INVENTION

The U.S. Government has rights in this invention pursuant to Contract Number N00024-79-C-4175 with the Department of the Navy.

The invention relates, in general, to a turning gear apparatus for a turbomachine; and, in particular, to a device which provides that there will be no inadvertent steam admission into the turbine casing when the turning gear is engaged; no inadvertent engagement of the turning gear and rotor while steam is admitted to the turbine casing; and, which automatically delivers gear mesh oil to the turning gear-rotor interface when the turning gear is engaged.

A turning gear is a motor driven gear train which selectively engages with and disengages from a turbine rotor to keep the rotor turning when it would otherwise cease rotation. The turning gear is particularly necessary after turning shutdown to promote even rotor cooling and to avoid rotor bowing or sagging during the cooling process. Rotor bowing is a potentially disastrous situation which may cause turbine vibration due to imbalance forces and/or destruction of internal turbine parts due to rubbing. The normal mode of turning gear operation is to close the trip-throttle valve, engage the turbine gear and rotor, and lock the turning gear into place by means of a detent. The present invention locks out the trip-throttle valve when the turning gear is engaged to prevent the inadvertent admission of steam into the turbine casing. A further benefit is the assurance of a supply of gear mesh oil when the turning gear is engaged.

Also, the present invention will defeat the inadvertent engagement of rotor and turning gear while the trip-throttle valve is open.

OBJECTS OF THE INVENTION

It is one object of the present invention to provide a turning gear apparatus that will engage a turbine rotor only if the trip-throttle valve is closed.

It is another object of the invention to provide a turning gear apparatus that will automatically deliver gear mesh oil whenever the turning gear is engaged.

It is a further object of the invention to provide a turning gear apparatus that will prevent trip-throttle valve opening if the turning gear is engaged.

The novel features believed characteristic of the present invention are setforth in the claims. The invention itself, however, together with further objects and advantages thereof, may best be understood with reference to the following description taken in connection with the drawings.

SUMMARY OF THE INVENTION

A turning gear interlock is located adjacent to a movable carriage which supports a driven gear train that is selectively engagable with the rotor ring gear. The turning gear interlock includes an axially slidable rod which is connected at one end to the movable carriage and which is positionable in an engage and disengage position. The rod is formed with several annular lands which interact with various ports in the interlock housing for the purpose of dispensing or retaining hydraulic fluid. The interlock is biased in the disengaged direction and hydraulically locked in that position.

BRIEF DESCRIPTION OF THE INVENTION

DETAILED DESCRIPTION OF THE INVENTION

Figure 1:
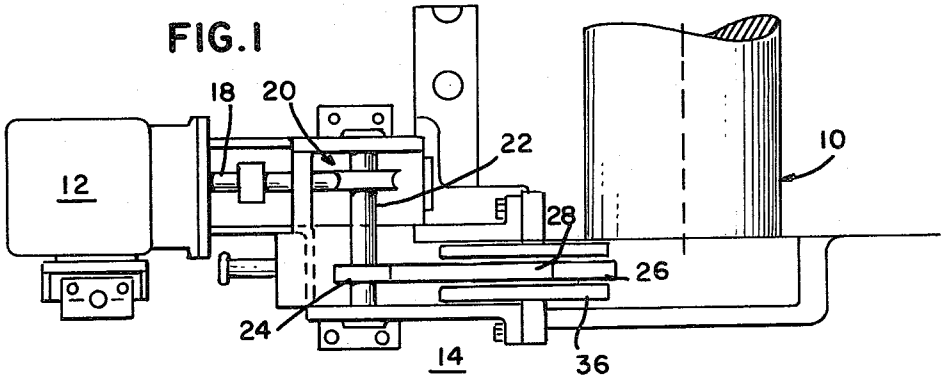
FIG. 1 is a top view of the turning gear apparatus.
Figure 2:
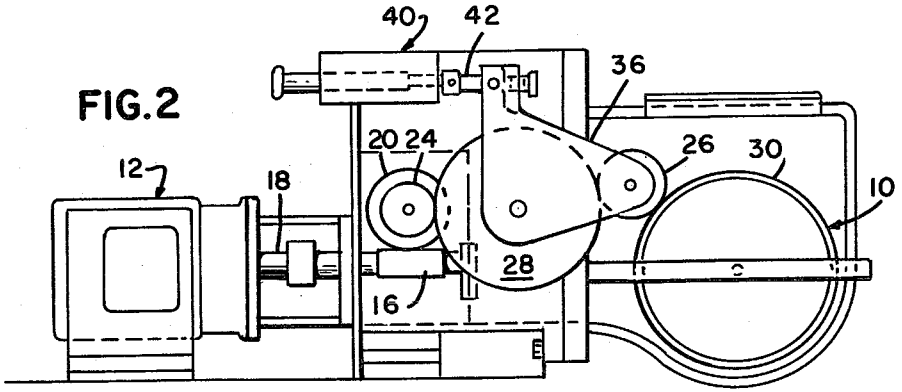
FIG. 2 is an elevation view of the turning gear apparatus.

FIGS. 1 and 2 taken together provide a schematic outline view of a turning gear which is the working environment of the present invention. A description of a turning gear is given in U.S. Pat. No. 3,919,894 to Keeter et al, assigned to the assignee of the present invention and incorporated herein by reference. In general, a turbine rotor 10 is driven to a relatively slow rate of about 12 to 25 rpm's by a motor 12 through a gear train 14 to be described. The motor is normally an electric motor but other prime movers such as gas or diesel may be acceptable.

The power train for the turning gear includes a worm gear 16 mounted on a motor-driven shaft 18, the worm gear driving a worm wheel 20. The worm wheel 20 is mounted on a common shaft 22 with a spur gear 24. Rotatable shaft 22 transmits power from worm wheel 20 to the spur gear 24. The output of the spur gear 24 is transmitted to a drive gear 26 through an idler gear 28. The drive gear in turn meshes with a ring gear 30 which is circumferentially mounted on the rotor 10. The drive gear 26 is positioned by a movable carriage 36 which is rotatable about a common axis of rotation with the idler gear 28. The carriage 36 is positioned by a turning gear interlock 40 through a connecting link 42. The turbine rotor 10 may also be rotated in the usual manner by introducing a supply of steam into the turbine casing through a trip-throttle valve. The general positioning and function of a trip-throttle valve is described in U.S. Pat. No. 4,033,234 to Nutter and Hoffman issued July 5, 1977 and also assigned to the assignee of the present invention and incorporated herein by reference. A further orientation of the turbine trip-throttle valve and turning gear interlock is given in connection with FIG. 5 yet to be described.

The operation of the turning gear is simple. When the turbine is under steam and operating; i.e., the trip-throttle valve is open, the turning gear is rotated out of contact with the turbine rotor or more specifically the rotor ring gear. When the trip-throttle valve is closed, the turbine will coast down to zero speed unless the turning gear is applied to the rotor ring gear. This is accomplished by meshing the drive gear with the ring gear as the carriage is positioned by means of the turning gear interlock. Oil is sprayed on the turning gear rotor ring gear mesh during their engagement.

Figure 4:
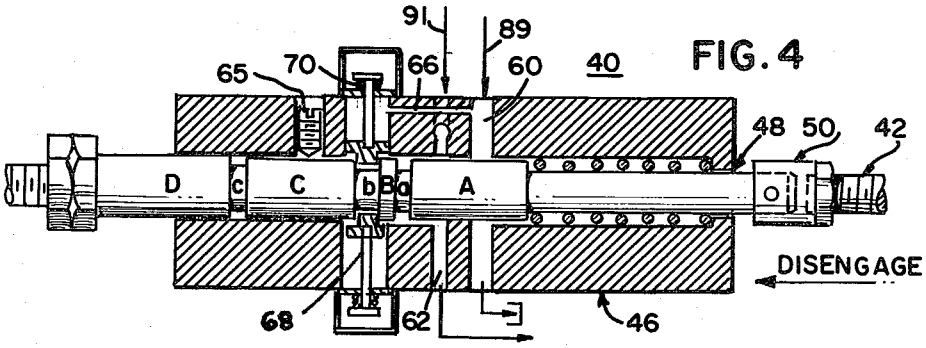
FIG. 4 is a cross-section view of the turning gear interlock in the disengaged position.
Figure 3:
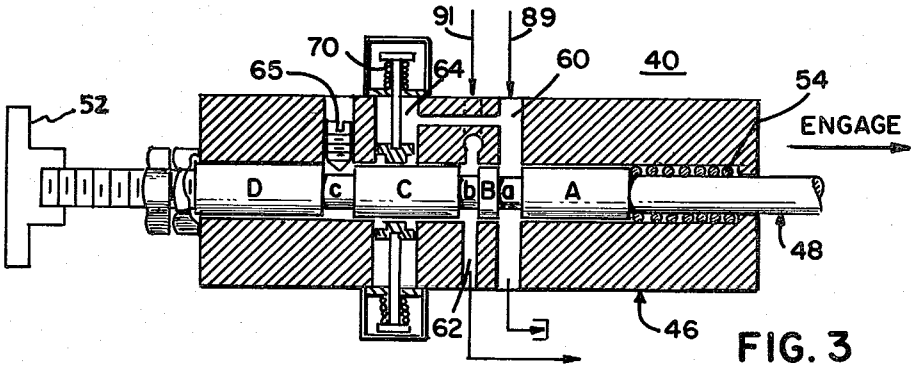
FIG. 3 is a cross-section view of the turning gear interlock in the engaged position.

FIGS. 3 and 4 show the turning gear interlock in the engaged and disengaged positions respectively. While the interlock is shown in combination with a particular turning gear configuration, it should be understood that other turning gear arrangements could be used in combination with the particular interlock without departing from the true spirit and scope of the invention.

The turning gear interlock includes a housing 46 having an axially slidable rod 48 mounted therein. The rod 48 is connected at one end to a movable carriage by means of connecting link 42 and connector 50. The other end of the rod 48 is connected to a handle 52 for a manual operation. The rod 48 is biased into the disengaged direction by means of a spring 54 concentrically mounted around the axially movable rod 48. The axially movable rod is formed with a plurality of annular lands A, B, C and D. Between these lands are portions of reduced diameter a, b and c otherwise identified as annular notches. The axially movable rod with its lands and notches; and, slidable within the turning gear interlock housing comprises a spool valve for porting or retaining hydraulic fluid as will be described.

The various lands and associated notches cooperate with various ports and stops. A first port 60 is associated with a trip-throttle valve and communicates with hydraulic fluid necessary to position the trip-throttle valve in the open position against a valve closing spring. In the engaged position shown in FIG. 3, the notch "a" between lands A and B allows port 60 to be connected to a drain whereby the trip-throttle valve cannot open while the rod 48 and consequently the turning gear is engaged with the rotor ring gear. This prevents the inadvertent admission of steam into the steam turbine while the turning gear is engaged.

Also, while the rod 48 is in the engaged position, notch "b" between lands B and C cooperates with a second port 62 to permit gear mesh oil to be passed through the turning gear interlock to the mesh between ring gear 30 and driving gear 26. The piping arrangement between the interlock and gear mesh site has not been shown in this schematic but would be a matter of choice to a person of ordinary skill in the art. Thus the supply of gear mesh oil may be controlled by the position of rod 48 and its associated lands and notches.

Finally, the rod 48 may be held positively in the engaged position by a screw detent 65 which cooperates with the annular notch "c" between lands C and D which arrangement is known in the prior art.

Referring now to FIG. 4, the rod 48 is shown in the disengaged position. In this position, land A blocks ports 62 and 60. In blocking port 60, the turning gear interlock allows the trip-throttle valve to become pressurized by closing off the drain. In blocking port 62, the turning gear interlock shuts off the supply of gear mesh oil to the turning gear-turbine interface. Moreover, the hydraulic pressure build-up is transmitted to chamber 64 through passage or hydraulic connection 66 so as to bear against the upper surface of piston or plunger 68. Piston 68 is biased radially outward from the axially slidable rod by means of spring 70. In the disengaged position, piston 68 is thrust radially inward against the bias of spring 70 to enter notch "b" between lands B and C. This causes the rod 48 to be automatically locked in the disengaged position until such time that the trip-throttle valve becomes depressurized through a drain.

Figure 5:
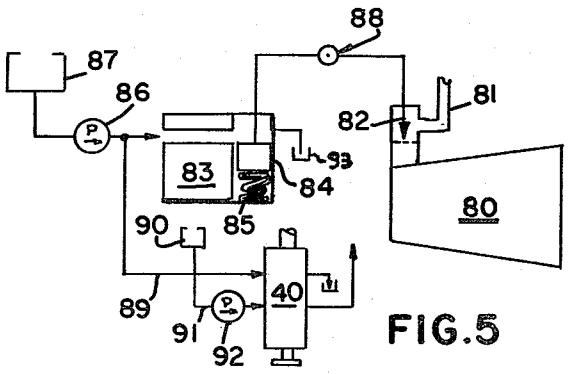
FIG. 5 is a schematic showing the interaction of the turning gear interlock with the steam admission valve.

Referring to FIG. 5, the operation of the present invention and its interaction with the steam admission or trip-throttle valve will become apparent. Steam is input into a steam turbine 80 through steam inlet 81. The passage of steam is controlled by a trip-throttle or steam admission valve 82. The position of the steam admission valve is controlled by means of a valve control manifold 83 which includes a piston 84 and a spring 85. Trip-throttle valve fluid is supplied through pumps 86 under pressure from reservoir 87 into the hydraulic manifold of the valve control 83 to position piston 84 which is in turn connected to control linkage 88. As fluid pressure works against spring 85, the steam admission valve opens.

Hydraulic fluid is also fed to the turning gear interlock 40 through line 89. As has been discussed previously, interlock 40 may drain hydraulic fluid away from the steam admission valve thereby preventing it from opening. Also, it is required to positively disengage the turning gear before the trip-throttle or steam admission valve will open. Likewise the oil supply 90 to the gear mesh area is independently supplied from a lube oil supply 91 through pump 92. A drain 93 is associated with the valve control manifold for independently positioning the trip-throttle valve and for depressurizing the interlock from the engage position.

In summary, the turning gear interlock may assume either an engage or disengage position. In the engaged position, port 60 is open to drain thus inhibiting the opening of the trip-throttle valve and inadvertent steam admission into the steam turbine. Likewise, port 62 is also open to deliver a gear mesh oil spray to the gear rotor interface whenever the turning gear is engaged. Finally, whenever the turning gear interlock is in the disengage position and the trip-throttle valve is open hydraulic fluid will drive piston 68 into notch "b" in rod 48 to positively and automatically prevent inadvertent engagement of turning gear and rotor.

While there has been shown what is considered to be a preferred embodiment of the invention it is also understood that other modifications may be made therein which may be obvious to one of ordinary skill in the art. It is intended to claim all such modifications as fall within the true spirit and scope of the invention.

What is claimed is:

1. A turning gear apparatus for a turbomachine of the type including a rotor and a motive fluid admission valve, said motive fluid admission valve mechanically connected to a hydraulic valve control manifold; the turning gear including a movable gear carriage for selectively engaging with and disengaging from a rotor ring gear wherein the turning gear further includes;

a turning gear interlock housing hydraulically connected to the valve control manifold; and, a spool valve axially slidable within the interlock housing for selectively blocking and porting hydraulic fluid through said housing; the spool valve being connected to the turning gear carriage whereby in the engaged position the interlock housing is ported thereby preventing pressurization of the valve control manifold and in the disengaged position the interlock housing is blocked to permit pressurization of the valve control manifold.

2. The turning gear recited in claim 1 wherein pressurization of the valve control manifold causes the fluid admission valve to open whereas depressurization of the valve control manifold causes the fluid admission valve to close.

3. The turning gear apparatus recited in claim 1 further comprising:

a port inlet connected to a supply of gear oil and a port outlet connected to the turning gear-ring gear mesh, the port being uncovered by the spool valve when the turning gear carriage is engaged.

4. The turning gear apparatus recited in claim 1 further comprising:

a plunger mounted in said interlock housing and disposed radially with respect to the spool valve; and, a hydraulic feedline connected to said plunger and the interlock housing hydraulic fluid inlet whereby when the housing is pressurized the plunger interlocks with the spool valve.

5. An improved turning gear for a steam turbine of the type including a rotor and steam admission valve, the steam admission valve being positioned by a hydraulic valve actuator; the turning gear including a movable gear carriage for selectively engaging with and disengaging from a rotor ring gear wherein the improvement comprises:

a turning gear interlock including a housing hydraulically connected to the valve actuator through a first port;

a spool valve slidable within said housing for selectively covering and uncovering said port; said spool valve further including notches along its axial length;

a plunger mounted in the housing and disposed radially with respect to said spool valve; and, a hydraulic feedline between said port and said plunger whereby if the interlock housing is pressurized the plunger is interlocked with the spool valve.

6. The turning gear recited in claim 5 wherein the improvement further comprises:

a second port inlet connected to a supply of gear oil and a second port outlet connected to the turning gear-ring gear mesh, the port being uncovered by the spool valve when the turning gear carriage is disengaged.

7. A turning gear for a turbomachine of the type including a rotor and a steam admission valve, the steam admission valve being positioned by a hydraulic valve actuator; the turning gear including a movable gear carriage for selectively engaging with and disengaging from a rotor ring gear wherein the turning gear further comprises:

an interlock housing hydraulically connected to the valve actuator through a first port;

a second port connecting the interlock housing to a supply of gear oil;

a spool valve slidable within said housing;

a plunger mounted in said housing and disposed radially with respect to the spool valve, said plunger biased away from said spool valve; and, a hydraulic feedline connecting the first port and plunger whereby in the engage position the first and second ports are uncovered and the plunger is raised and in the disengage position the first and second ports are covered and the plunger is interlocked with the spool valve.

* * * * *